United States Patent [19]

Auslander et al.

[11] Patent Number: 4,619,237

[45] Date of Patent: Oct. 28, 1986

[54] ENGINE COLD STARTING

[76] Inventors: David M. Auslander, 411 Kentucky Ave., Berkeley, Calif. 94707; Masayoshi Tomizuka, 698 Grizzly Peak Bl., Berkeley, Calif. 94708; Paul Sagues, 1731-D Spruce St., Berkeley, Calif. 94709; Takashi Ishida, 649 Kamiohi, Ohimachi, Kanagawaken; Shuichi Kamiyama, No. 2-4-5, Honkomagome, Bunkyo-ku, Tokyo, both of Japan

[21] Appl. No.: 799,277

[22] Filed: Nov. 18, 1985

Related U.S. Application Data

[63] Continuation-in-part of Ser. No. 677,892, Dec. 4, 1984, abandoned, which is a continuation of Ser. No. 497,894, May 25, 1983, abandoned.

[51] Int. Cl.[4] ..... F02D 11/10

[52] U.S. Cl. ..... 123/491; 123/399; 123/489; 123/179 G; 123/179 L

[58] Field of Search ..... 123/179 G, 179 L, 491, 123/440, 489

[56] References Cited

U.S. PATENT DOCUMENTS

| | | | |
|---|---|---|---|
| 3,964,457 | 6/1976 | Coscia | 123/339 |
| 4,191,051 | 3/1980 | Kawata | 123/340 |
| 4,297,978 | 11/1981 | Matsui . | |
| 4,321,902 | 3/1982 | Stoltman | 123/179 G |
| 4,352,346 | 10/1982 | Osano | 123/179 G |
| 4,399,789 | 8/1983 | Yano . | |
| 4,401,079 | 8/1983 | Aoki | 123/179 G |
| 4,434,760 | 3/1984 | Kobayashi . | |
| 4,469,064 | 9/1984 | Manaka | 123/339 |

*Primary Examiner*—Ronald B. Cox

[57] ABSTRACT

A method and apparatus for starting a cold internal combustion engine under optimum conditions. Engine r.p.m. is maintained to a desired value until either the car is started, driven, or the temperature of the engine reaches a predetermined value, whichever first occurs. During this time, the ratio between the air and fuel fed to the engine is kept at the optimum values corresponding to the prevailing engine conditions during this time.

4 Claims, 9 Drawing Figures

$t_{op}$ = TIME $T_{op}$ = SAMPLING TIME FOR THE A/F OPTIMIZER $N_o$ = DESIRED ENGINE SPEED $K_p, K_i, K_d$, = PARAMETERS OF THE SPEED CONTROLLER $\Delta AF$ = STEP SIZE FOR USE IN THE OPTIMIZER FIG _ 8
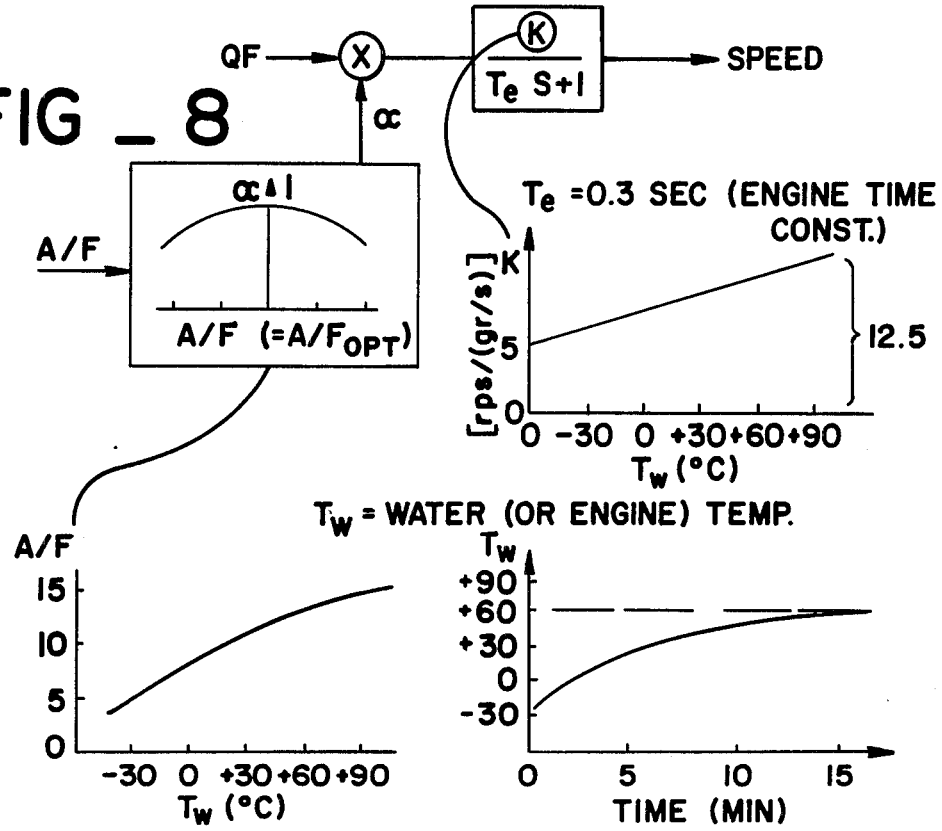
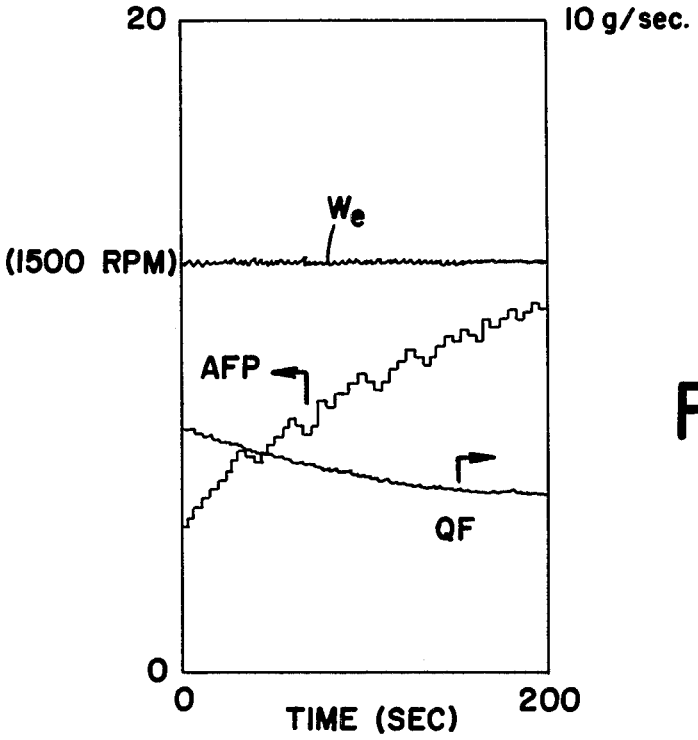
FIG _ 9

ENGINE COLD STARTING

This application is a continuation-in-part of application Ser. No. 06/677,892, filed Dec. 4, 1984, now abandoned, which is continuation of 06/497,894, filed May 25, 1983, now abandoned.

This invention relates to electronic fuel control systems for spark ignition internal combustion engines of the so-called "drive by wire" type (e.g., Engine Air Control (EAC) systems wherein fuel flow rate is operator initiated and airflow rate is controlled as a function of fuel flow rate). More particularly, the invention relates to such a system that provides desirable engine response characteristics during cold starting periods.

BACKGROUND OF THE INVENTION

In the operation of internal combustion engines, cold-starting has long been a significant problem because, until the engine and fuel are up to normal temperature levels, efficient fuel combustion cannot take place, and operation at other than normal engine speed and normal air-fuel ratio was required. For engines using carburetion systems, automatic choke systems were devised, and in conventional fuel injection systems, a fast idle control device responsive to temperature was used. Both of these systems affect the flow of air into the engine. In the aforementioned drive by wire system, e.g., EAC system, the problem has been somewhat different because the airflow rate is directly controlled by a movable throttle plate in the air intake conduit and the system is constantly attempting to adjust the position of this plate to provide an optimum airflow rate. One serious problem with both of the aforesaid approaches was that they inherently consumed excessive fuel during cold starts and also created excessive emissions of unburned hydrocarbons from the engine.

SUMMARY OF THE INVENTION

The invention provides a method for starting a cold internal combustion engine in a highly fuel efficient manner. In this method, a predetermined optimum engine r.p.m. is, under computer control, initially maintained or gradually reduced until either the car is driven or the temperature of the engine reaches a predetermined value, whichever first occurs. During the warm-up period, the ratio between the air and fuel fed to the engine is kept by the computer at the optimum values corresponding to the prevailing engine conditions during this time.

More specifically, in one embodiment, the invention keeps the engine speed at 1500 r.p.m. or 25 r.p.s. until the engine or the temperature of its coolant reaches 60° C., or until the car is driven. In either event, there is no need to keep the engine speed at that value from then on, so far as the cold start is concerned. During the same cold start operation, the invention provides the engine with the optimum fuel flow and the optimum airflow value in order to minimize fuel consumption. Since these optimum values depend upon the engine temperature and other values that change during the process, they cannot be preprogrammed into the engine; so in the present invention, they are determined by the computer, the optimum value being continually found and tracked during the operation.

The invention also includes apparatus for providing optimum conditions when starting a cold internal combustion engine of the type having a combustion zone, coolant for cooling that zone, and a coolant circulation system, a throttle for controlling airflow to that zone, fuel injection means for injecting fuel into that zone, and an accelerator pedal. The apparatus includes a transducer for obtaining an electrical driver command signal (interpreted as a fuel command signal in the case of an EAC system) from the position of the accelerator, an engine coolant temperature sensor for producing an electrical signal corresponding to the instant coolant temperature, an engine speed sensor, and an airflow pressure differential sensor for sensing the pressure of the airflow before and after the throttle valve and for producing an electrical signal corresponding thereto.

These signals are all converted to digital values in a computer which calculates therefrom, while employing stored values relating to optimum air-fuel ratios under various engine conditions, the proper throttle valve position and proper injector pulse width needed to obtain the current optimum ratio of air to fuel. The computer then sends signals to the throttle valve actuator and the fuel injector actuator to produce these desired conditions. During this warm-up period and until the engine temperature reaches the preselected temperature marking the end of the warm-up period, e.g., 60° C., the computer provides the control for both the engine speed and the fuel-air ratio.

Other objects, advantages, and features of the invention will appear from the following description:

BRIEF DESCRIPTION OF THE DRAWING

FIG. 8 is a diagram set illustrating a computer simulation example of the system of FIG. 5.

FIG. 9 is an approximate reproduction of the C-R-T graph produced by the simulation of FIG. 8.

DESCRIPTION OF A PREFERRED EMBODIMENT

The invention applies to engine cold starting and provides a method for maintaining the speed of the engine during engine warm-up while also optimizing the air-fuel ratio during that time, in terms of the best fuel economy.

Figure 1:
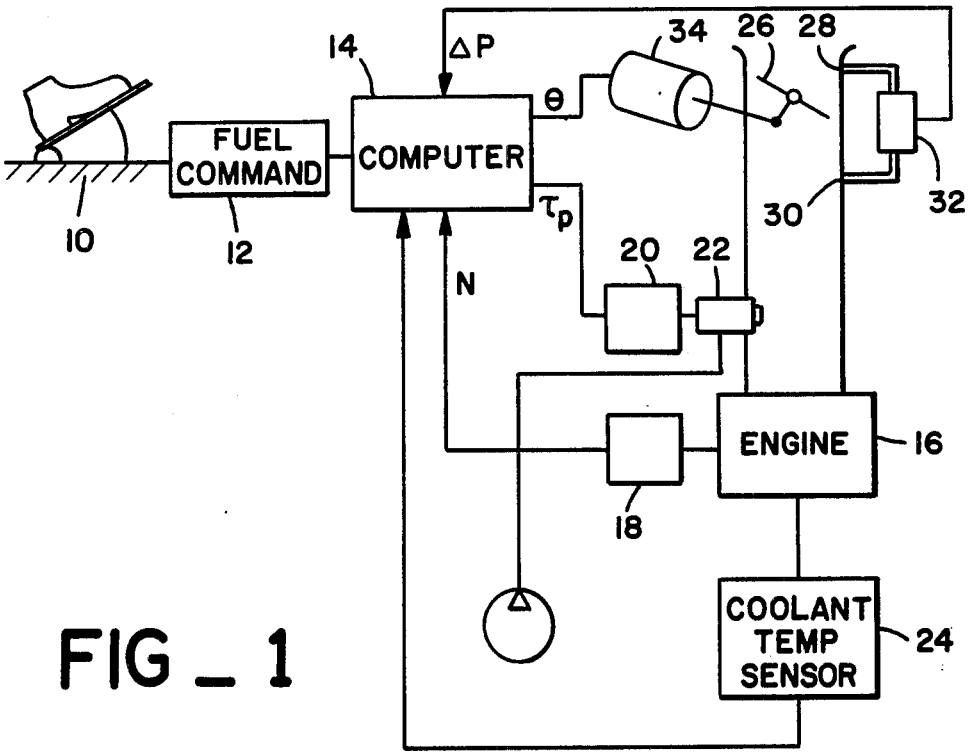
FIG. 1 is a block diagram of a system embodying the principles of the invention.

An overall schematic diagram of an EAC system embodying the principles of the invention is shown in FIG. 1. An accelerator pedal 10 has it position measured by an acceleration pedal position sensor 12 which sends an electrical signal to a computer 14, where the analog voltage values are converted to digital values. The computer 14 interprets the digital signal as the driver's fuel compound QF.

An engine 16 has an engine speed sensor 18 which sends an engine speed signal N (or a signal indicating the time that the engine rotates a predetermined angle)

to the computer 14. In this arrangement, the computer 14 converts the analog voltage values to digital values and finds therefrom an injector pulse width $\tau_p$ based on QF, the driver's fuel command and N, the engine r.p.m. If desired, digital engine speed signals could be supplied from a suitable sensor directly to the computer. This injection pulse width provides a signal to an actuator 20 for a fuel injector 22, so that the correct fuel injection occurs. A sensor 24 detects the temperatures $T_w$ of the engine coolant and sends a signal corresponding thereto to the computer 14, where again the analog voltage is converted to a digital value for $T_w$. Again, digital temperature sensor could be used.

The computer 14 determines (as will be described) the optimum air-fuel ratio corresponding to the temperature $T_w$, changing the ratio as $T_w$ changes, and also in accordance with other engine conditions described below. Then using the fuel command QF, the computer 14 determines the proper airflow QA to match the previously determined air-fuel ratio. The computer 14 further finds a throttle valve angle $\theta$ needed to produce the airflow rate QA when considering the differential pressure across a throttle valve 26. This differential pressure is sensed by sensor elements 28 and 30 of a differential pressure meter 32, which sends its signal $\Delta P$ to the computer 14, where the analog voltage is converted to digital values. The computer 14 sends the value $\theta$ to an actuator 34 for the throttle 26 to move it to the angle $\theta$ and adjust the airflow.

In operation, the computer 14 is preferably turned on with the ignition switch. An initial throttle angle $\theta_1$ and an initial air-fuel ratio $A/F_1$ are set by the computer 14 as a function of the coolant temperature $T_w$ and, preferably, other selected engine variables and parameters, as discussed below. The initial air-fuel ratio A/F, is put into the memory of the computer 14 as a function of the engine parameters at the time the optimum control starts functioning.

When the engine r.p.m. reaches a prescribed value $N_1$, the computer 14 starts decreasing the injector pulse width $\tau_p$ until the air-fuel ratio reaches a prescribed value A/F. Thus, the engine speed during warm-up idling is under direct digital control. During this warm-up period, the engine speed is set and maintained by the computer 14 and its ancillary apparatus, and the computer 14 at this time permits no interference or overriding by the vehicle operator, even if he depresses the accelerator pedal.

A desired fast idle speed $N_0$, which is the idle r.p.m. during engine warm-up in the apparatus of this invention, can be made a function of $T_w$ and other selected variables. To maintain the engine r.p.m. close to the desired value $N_0$ the computer 14 adjusts the fuel-flow rate QF, as well as other variables, such as spark advance. This adjustment involves the following equation:

$$QF(j) = K_p[N_o - N(j)] + K_i \sum_{i=0}^{j} [N_o - N(i)] + K_d[N(j-1) - N(j)]$$

where j corresponds to the j-th time instance that the engine r.p.m. N(j) is measured, and $K_p$, $K_i$ and $K_d$ are engine speed servo gain parameters which can be made functions of $T_w$, the air conditioner ON/OFF switch, and the engine r.p.m. The period between two successive time instances ($T_s$) is either fixed or variable.

Based on this QF(j) the desired airflow QA(j) is computed by:

$$QA(j) = QF(j) \times A/F$$

where the A/F value is adjusted by the optimizer, as will be described below.

The computer 14 sets the injector pulse width $\tau_p$ as a function of QF(j) and N(j). Based upon QA(j) and the differential pressure $\Delta P$ across the throttle valve 26, the computer 14 then finds the throttle angle $\theta$ to achieve the desired airflow and sends that value to the actuator 34 which adjusts the valve 26.

Fuel optimizing is achieved by the computer 14 which increases or decreases the air-fuel ratio, so that the amount of fuel QF is minimized, while keeping the engine r.p.m. of the desired value $N_O$. To accomplish this goal, the computer watches the following relationships:

$$S = \mathrm{Sgn}[A/F(k \times T_{opt}) - A/F((k-1) \times T_{opt})],$$

$$\mathrm{Sgn}[\Delta] = 1 \text{ for } \Delta > 0, \ \mathrm{Sgn}[\Delta] = -1 \text{ for } \Delta > 0$$

and $$\Delta QF = QF(k \times T_{opt}) - QF(k-1) \times T_{opt})$$

where k is the integer time index, $T_{opt}$ is the optimizer sampling period.

Figure 2:
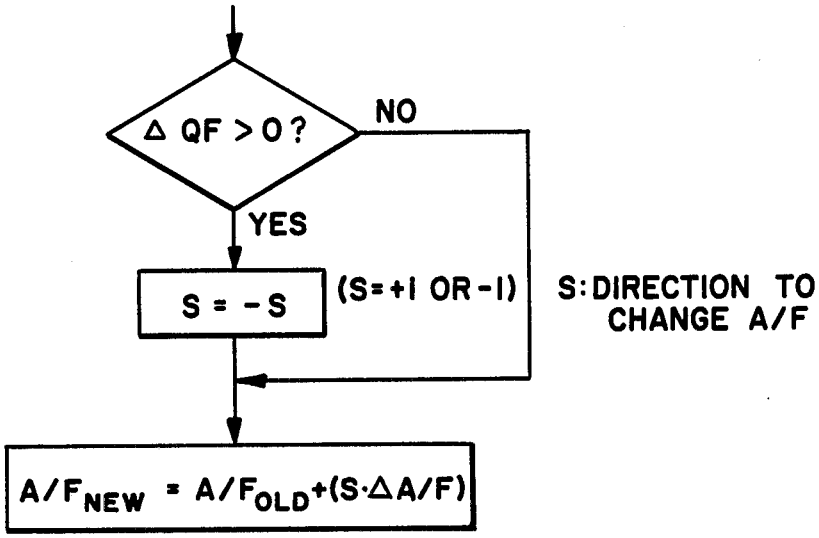
FIG. 2 is a flow diagram of the logic for the optimizing operation of the system of FIG. 1.

The logic of these equations is shown in the logic flow diagram, FIG. 2. The computer 14 asks whether $\Delta$QF is greater than 0. If it is, it implies that the change in the air/fuel ratio $\Delta$A/F must have been made opposite in the optimization cycle and we set S=−S. S, therefore, serves to indicate in which direction the last change was made. If $\Delta QF < 0$, we do not change the sign of $\Delta$A/F since the A/F has moved in the direction of decreasing the quantity of fuel supplied. After setting S to the direction of decreasing supplied fuel, a new value for A/F is computed by:

$$A/F_{new} = A/F_{old} + (S \cdot \Delta A/F)$$

Figure 3:
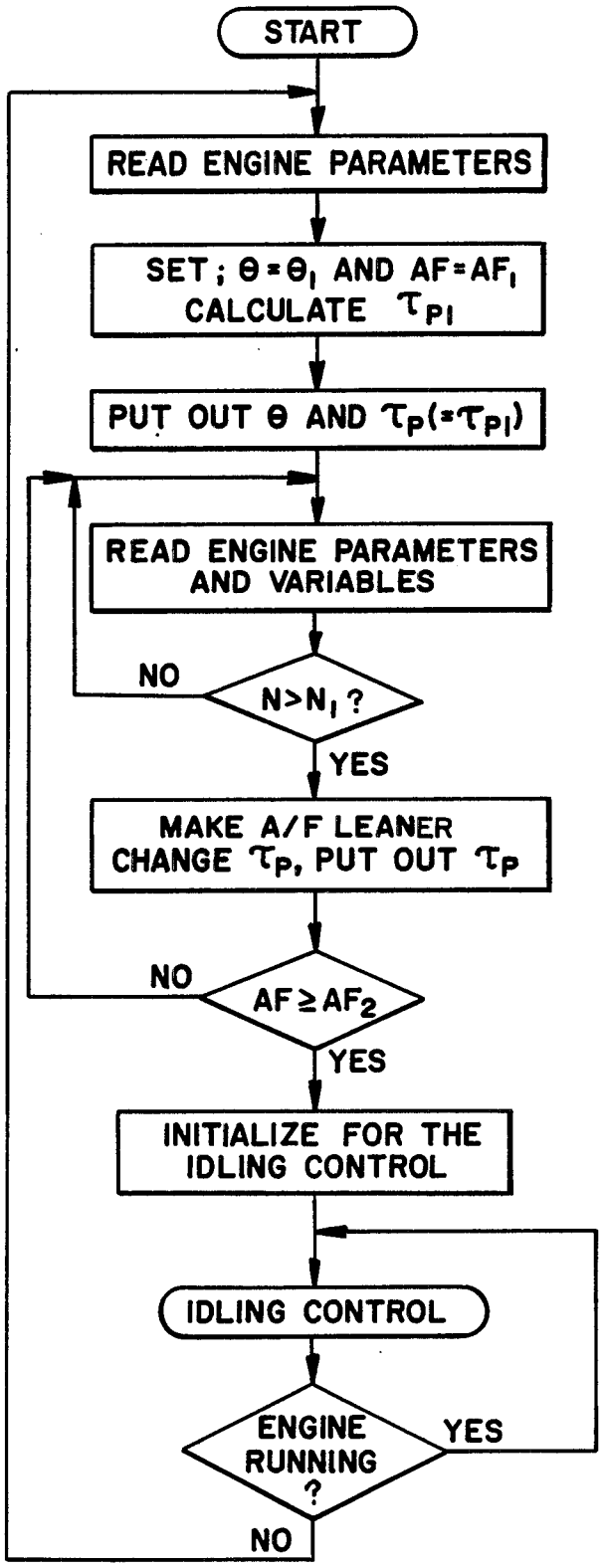
FIG. 3 is a flow diagram of the logic for the cold-start operation of FIG. 1.

FIG. 3 shows the logic flow as performed by the computer 14 during the complete cold start sequence. It begins with the box marked START, when the ignition switch and computer 14 are turned on. The first thing done by the computer 14 is to read the engine and servo parameters $T_w$, $K_p$, $K_i$, and $K_d$. Then the throttle valve angle $\theta$ is set to $\theta_1$, A/F is set to $A/F_1$, and the pulse width $\tau_p$ is calculated. The computer then outputs the angle $\theta$, and the pulse width $\tau_{p1}$ to the throttle actuator 34 and to the fuel injector 22, respectively.

Next, the engine parameters and variables are read, and the question asked whether N is greater than $N_1$, that is, whether the engine speed is greater than the prescribed engine speed N. If the answer is "no", this step is repeated, until N is greater than $N_1$. If N is greater than $N_1$, then the air-fuel ratio is made leaner, to produce a new ratio $A/F_2$, and injector pulse width is changed to a new value, which is sent to the actuator 20 for the fuel injector 22.

Next, the question is raised whether the air-fuel ratio A/F is equal to or greater than $A/F_2$, if not, the computer 14 goes back to reread the engine parameters and variables and again goes through the procedure already described until the air-fuel ratio, A/F, is greater than or equal to $A/F_2$. When that is true, the device is initialized for idling control.

The question is then asked whether the engine 16 is running. If not, the computer 14 goes back to the starting condition and goes over everything again. If the engine 16 is running, then the computer loops back to idling control.

Figure 4:
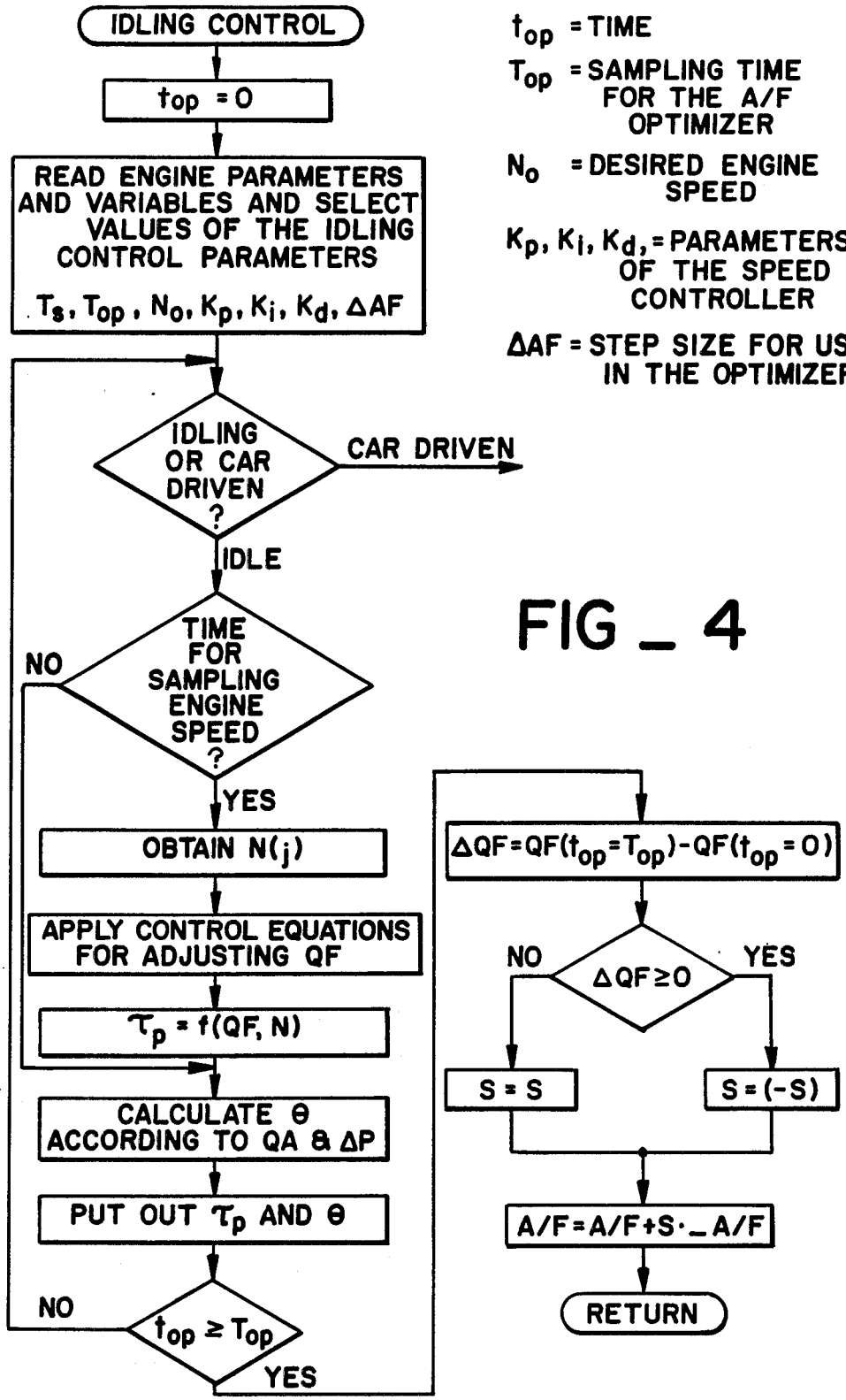
FIG. 4 is a flow diagram for the logic for the idling control portion of FIG. 3.

Idling control is explained further in FIG. 4, another logic flow diagram. This begins by setting $t_{op}$ to 0, meaning 0 time. Then the engine parameters and variables are read and the values of the idling control parameters are set. These include:

$T_s$, the sampling time for the revolution servo control.

$T_{op}$, the sampling time for the air-fuel ratio optimizing control, $N_0$, which is the desired engine idle speed, $K_p$, $K_i$, and $K_d$, which are coefficients of the servo control, and $\Delta A/F$, the step size for use in the A/F optimizer.

The computer next asks the question whether the engine is idling or the car is being driven. If not idling, the air-fuel ratio is changed to produce the correct ratio for driving. If it is idling, then the next thing to do is to calculate QF(j) as explained above, and then QA(j) as shown above. Following that, $\tau_p$ is calculated according to the equation $\tau_p = f(QF,N)$, meaning that it is a function of the quantity of fuel fed to the engine per unit of time and the r.p.m. of the engine. The relationships for this function are stored in the computer 14. The computer 14 then puts out the values of $\tau_p$ to the fuel injector actuator 20.

At that point, the computer 14 respectively calculates the throttle angle $\theta$, based upon QA and $\Delta P$.

The computer 14 asks the question whether $t_{op}$, the time since the last optimizer sampling period, is greater than or equal to $T_{op}$. If the answer is "no", the computer loops back to a point in the program just beyond where the value of T is set to 0 and goes through the operation again. If the answer is "yes", then $\Delta QF$ is determined by the equation:

$$\Delta QF = QF(t_{op} = T_{op}) - QF(t_{op} = 0)$$

The question is then asked whether $\Delta QF$ is greater than 0. If it is, then the direction of change S is reversed, and if not, then the sign of S is not changed. This determines whether $\Delta QF$ is increasing or decreasing the value of QF. This adjustment can then be made upon the air-fuel ratio based on the equation:

$$AF = AF + S \times \Delta AF,$$

after which the computer program returns from this idling control routine.

Figure 5:
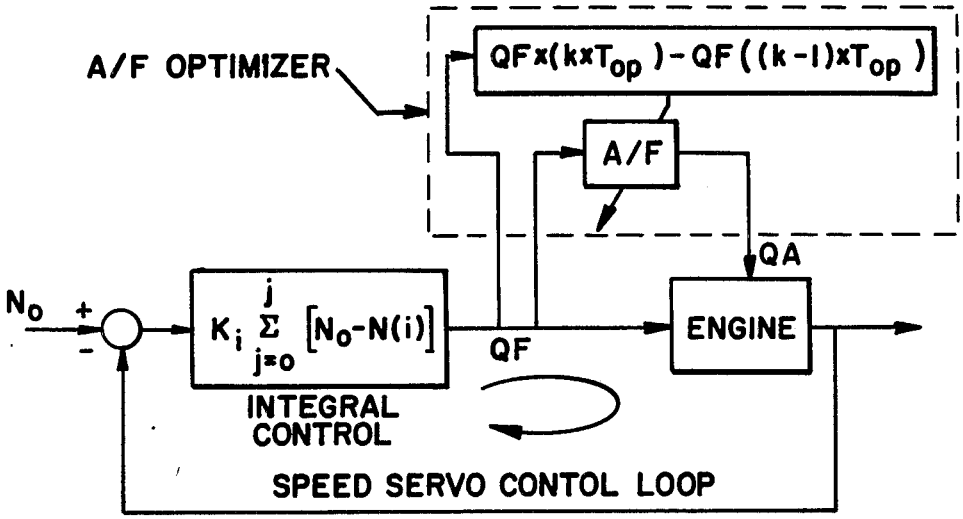
FIG. 5 is a block diagram of a digital servo control loop representing an improvement in the system of FIGS. 2–6.
Figure 6:
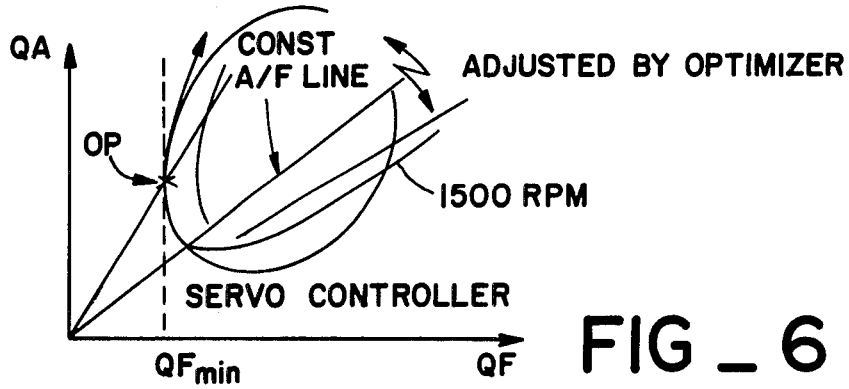
FIG. 6 is a graph of QA versus QF in the system of FIG. 5.

The invention is further explained by the block diagram in FIG. 5 and the QF—QA relation in FIG. 6. As shown in FIG. 6, the adjustment of QF by the servo controller for maintaining the engine speed at the desired speed is followed by QA so that the QF and QA move on a constant A/F line. The optimizer loop in FIG. 5, running with a larger sampling time, $T_{op}$, than the servo sampling time, $T_s$, adjusts the slope of A/F line so that the engine can be operated at the point labelled OP in FIG. 6. $T_{op}$ is selected to be larger than $T_s$ in order to make sure that the engine r.p.m. and fuel flow rate settle down to new values before further change is made in the air-fuel ratio.

Figure 7:
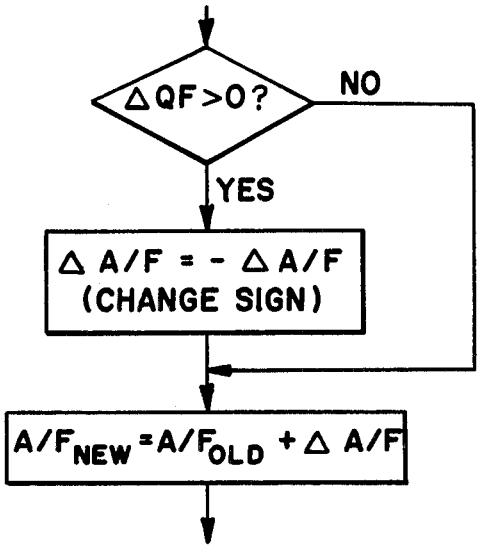
FIG. 7 is a flow sheet of the optimizer logic for the system of FIG. 5.

An integral action must be included in the servo controller in order to maintain the engine speed around 1500 r.p.m. under the influence of unknown factors. If necessary, a proportional, derivative (line one in FIG. 4) and other feedback control actions can be added for improving the response speed and stability of the servo loop. The servo control included in FIG. 7 is of the I-type and may be written as:

$$QF(j) = QF(j1) + k_i(N_o - N(j))$$

where $N_o$ is the reference rotational speed of the engine, normally 1500 r.p.m. or 25 r.p.s. for fast idling and 700 r.p.m. for slow idling.

In this embodiment of the invention the optimizer can either increase or decrease the air-fuel ratio, so that QF can be decreased while maintaining the engine speed at 1500 r.p.m. For this purpose, the computer keeps track of the following calculations:

$$\Delta A/F = A/F(kT_{opt}) - A/F((k-1)T_{opt})$$

$$\Delta QF = QF(kT_{opt}) - QF((k-1)T_{opt})$$

The logic for this is explained in the flow chart of FIG. 7.

This begins with the question whether $\Delta QF$ is greater than zero. If it is, then the sign of $\Delta A/F$ is reversed. If $\Delta QF$ is not greater than zero, no change of signs is required, i.e., the air-fuel ratio is changed in a direction that decreases fuel consumption. After finding the correct direction to change A/F, then $$A/F_{new} = A/F_{old} + \Delta A/F.$$

This optimization is executed every $T_{opt}$ second. $T_{opt}$ must be large enough for the engine speed and fuel flow to settle to values for a given A/F ratio under digital servo control.

The above mentioned optimization is for minimizing the amount of fuel. However, if desired, the optimization can be done for the minimization of an engine performance index, the value of which is a combination of fuel economy and other engine related variables such as smoothness of the engine idling.

Thus, the invention comprises maintaining the engine r.p.m. at a predetermined value when the temperature of the engine is below a predetermined value and when the engine is idling. It also includes changing the air-fuel ratio in the direction where fuel consumption is expected to decrease. Such changing is made after comparing fuel consumption immediately after the lapse of a predetermined time with fuel consumption immediately before the end of that predetermined time and also after detecting the way the air-fuel ratio changes immediately before the end of the predetermined time. The method may also comprise controlling the throttle opening and the amount of fuel flow in such a way as to obtain a rich air-fuel ratio at the time of cranking corresponding to the engine parameters. The air-fuel ratio is made leaner after the engine r.p.m. has reached a predetermined value after starting. Optimum control is activated after the lapse of a predetermined time after the initial air-fuel ratio, at the time the optimum control starts functioning, has been reached.

To test the cold start scheme just described, a digital computer simulation was made, as shown in FIGS. 8 and 9. The water or engine coolant temperature $T_w$ is plotted against the air-fuel ratio A/F, as shown, at the lower left of FIG. 8 and the time in minutes plotted against the temperature $T_w$ at the lower right of FIG. 8. At the upper left is shown the curve when the air-fuel ratio A/F is plotted against A/F which is the same as $A/F_{opt}$. At the upper right $T_w$ is plotted against engine speed divided by grams of fuel per second: r.p.s./gr/s.

For the servo controller, it was found that $T_s$ was equal to 0.2 seconds, and $k_i$ or (r.p.s./gr/sec) was equal to 0.05. This is the control gain. In the optimizer $T_{op}$ equals a 3 second sampling period and $|\Delta A/F|$ equals 0.25.

The results of this simulation are shown in FIG. 9, where it can be seen that the engine speed is regulated well around the 1500 r.p.m., and the actual air-fuel ratio closely follows the optimal air-fuel ratio with some oscillation. The values themselves are not particularly significant, since arbitrary relations were selected for this part, but the qualitative behavior is important, and that is shown.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

It is claimed:

1. An optimum control method for starting and idling a cold internal combustion engine which controls the feed of both fuel and air by a computer control unit, comprising, maintaining the engine r.p.m. at a predetermined value when the temperature of the engine is below a predetermined value and when the engine is idling, changing the air-fuel ratio in the direction where fuel consumption is expected to decrease, such changing being made after comparing fuel consumption at this sampling time with fuel consumption at the last sampling time and being due to the direction of the air-fuel ratio change at the last sampling time.

2. The method of claim 1 including putting the initial air-fuel ratio, at the time the optimum control starts functioning into the computer's memory as a function of the engine parameters.

3. The method of claim 1 including:

controlling the throttle opening and the amount of fuel flow in such a way as to obtain rich air-fuel ratio at the time of cranking corresponding to the engine parameters, and making the air-fuel ratio leaner after the engine r.p.m. has reached a predetermined value after starting, and activating the optimum control function after a lapse of a predetermined time after the air-fuel ratio has reached a predetermined air-fuel ratio for the optimum control.

4. Apparatus for providing optimum conditions when starting a cold internal combustion engine having a combustion zone, coolant for cooling said zone and coolant circulation means, a throttle for controlling airflow to said zone, fuel injection means for injecting fuel into said zone, and an accelerator pedal, comprising:

transducer means for obtaining an electrical fuel command signal (or driver's command to the engine) from the position of said accelerator;

engine temperature detection means for producing an electrical signal corresponding to the instant temperature;

engine speed sensing means for producing an electrical engine speed signal;

airflow pressure differential sensing means for sensing the pressure of the air before and after the throttle valve and producing an electrical signal corresponding thereto;

a throttle valve actuator;

a fuel injector actuator; and computer means for receiving the fuel command signal, said engine speed signal, engine water temperature signal, and airflow differential pressure signal, converting their analog signals to digital values, and for calculating therefrom, while employing stored values relating to optimum air-fuel ratios under various engine conditions, the proper throttle valve position needed to obtain the current optimum ratio of air to fuel and the current proper fuel flow, and for sending signals to said throttle valve actuator and said fuel injector actuator to effectuate these conditions;

whereby the engine is kept at a predetermined r.p.m. and fed fuel and air at the optimum ratios and values until a desired engine temperature is reached or the car is driven.

* * * * *

UNITED STATES PATENT AND TRADEMARK OFFICE

CERTIFICATE OF CORRECTION

PATENT NO. : 4,619,237

DATED : October 28, 1986

INVENTOR(S) : David M. Auslander et al

It is certified that error appears in the above-identified patent and that said Letters Patent is hereby corrected as shown below:

Column 2, line 60, "it" should read -- its --.

Column 2, line 65, "compund" should read -- command --.

Signed and Sealed this

Thirteenth Day of October, 1987

*Attest:*

DONALD J. QUIGG

*Attesting Officer*

*Commissioner of Patents and Trademarks*